US010005633B2

(12) United States Patent
Foreman

(10) Patent No.: US 10,005,633 B2
(45) Date of Patent: Jun. 26, 2018

(54) DISPENSERS

(71) Applicant: Marc Franklin Foreman, Woodland Hills, CA (US)

(72) Inventor: Marc Franklin Foreman, Woodland Hills, CA (US)

( * ) Notice: Subject to any disclaimer, the term of this patent is extended or adjusted under 35 U.S.C. 154(b) by 359 days.

(21) Appl. No.: 15/009,253

(22) Filed: Jan. 28, 2016

(65) Prior Publication Data

US 2016/0221788 A1 Aug. 4, 2016

Related U.S. Application Data

(60) Provisional application No. 62/110,197, filed on Jan. 30, 2015.

(51) Int. Cl.

| | |
|---|---|
| ***B65H 16/00*** | (2006.01) |
| ***B65H 35/00*** | (2006.01) |
| ***B65D 83/08*** | (2006.01) |
| ***B65D 85/671*** | (2006.01) |
| ***B65D 43/16*** | (2006.01) |
| ***B65D 85/672*** | (2006.01) |

(52) U.S. Cl.

CPC ..... *B65H 16/005* (2013.01); *B65D 43/16* (2013.01); *B65D 83/0841* (2013.01); *B65D 85/671* (2013.01); *B65D 85/672* (2013.01); *B65H 35/0026* (2013.01); *B65H 2301/41282* (2013.01); *B65H 2301/41306* (2013.01)

(58) Field of Classification Search

CPC ..... B65H 16/005; B65H 35/0026; B65H 2301/41306; B65H 2301/41282; B65D 85/671; B65D 85/672; B65D 43/16; B65D 83/0841

See application file for complete search history.

(56) References Cited

U.S. PATENT DOCUMENTS

| | | | | |
|---|---|---|---|---|
| D169,356 | S | 4/1953 | Brown | |
| 3,229,926 | A * | 1/1966 | Weber | B65H 16/005 242/129.51 |
| D276,354 | S | 11/1984 | Spitzer | |
| 4,570,794 | A * | 2/1986 | Capitao, Jr. | B65D 85/672 206/394 |
| 4,735,342 | A * | 4/1988 | Goldstein | B65D 85/672 206/394 |
| D321,091 | S | 10/1991 | Dickinson | |
| 5,069,361 | A | 12/1991 | Jeffway et al. | |
| D332,281 | S | 1/1993 | Silverman | |
| D344,456 | S | 2/1994 | Argondizza | |
| D365,852 | S | 1/1996 | Parsey et al. | |
| D387,903 | S | 12/1997 | Jacoby et al. | |
| D412,062 | S | 7/1999 | Potter et al. | |
| D451,278 | S | 12/2001 | Cooper | |
| D551,893 | S | 10/2007 | Huang | |
| D591,354 | S | 4/2009 | Vulpitta | |
| D609,274 | S | 2/2010 | Hsu et al. | |
| D646,330 | S | 10/2011 | Chen | |
| D647,304 | S | 10/2011 | Packard et al. | |

(Continued)

*Primary Examiner* — William E Dondero

(74) *Attorney, Agent, or Firm* — Henricks, Slavin & Holmes LLP

(57) ABSTRACT

A dispenser with a case including a base and a cover that together define an internal storage region, and an adjustable axle assembly, mounted within the internal storage region of case, including an axle and at least one movable stop that is configured to be secured to the axle.

17 Claims, 4 Drawing Sheets

(56) References Cited

U.S. PATENT DOCUMENTS

| | | | | |
|---|---|---|---|---|
| D656,548 | S | 3/2012 | Packard et al. | |
| D656,549 | S | 3/2012 | Packard et al. | |
| D657,420 | S | 4/2012 | Clover et al. | |
| D687,102 | S | 7/2013 | Chandaria | |
| D700,240 | S | 2/2014 | Chapin et al. | |
| D741,705 | S | 10/2015 | Astorga et al. | |
| D753,762 | S | 4/2016 | Chandaria | |
| 2006/0151660 | A1* | 7/2006 | Stringer | B65D 83/0805 242/588.3 |
| 2014/0077023 | A1 | 3/2014 | Foreman | |
| 2016/0152434 | A1* | 6/2016 | Diangelo | B65D 25/04 225/34 |

* cited by examiner

DISPENSERS

CROSS-REFERENCE TO RELATED APPLICATIONS

This application claims the benefit of U.S. Provisional Application Ser. No. 62/110,197, filed Jan. 30, 2015 and entitled "Dispensers," which is incorporated herein by reference in its entirety.

BACKGROUND

1. Field

The present inventions relate generally to dispensers for that may, for example, be used to dispense tape and other dispensable objects that are stored in roll form.

2. Related Art

A variety of dispensable objects (or "rolled objects") are stored in roll form and cut to length as they are consumed. Such objects include tape, such as painter's tape, masking tape, adhesive tape, and packaging tape, as well as non-adhesive objects such as ribbon and barrier (or "police") tape. The objects are typically rolled around a core, such as a cardboard core, to form a "roll." The rolls of tape, ribbon and the like are available in a variety of widths and, in many instances, a user's project will require a number of different widths. Painters, for example, frequently require painter's tape of different widths and colors and it is difficult for the user to hold, and dispense from, multiple rolls simultaneously.

SUMMARY

A dispenser in accordance with at least one of the present inventions includes a case including a base and a cover that together define an internal storage region, and an adjustable axle assembly, mounted within the internal storage region of case, including an axle and at least one movable stop that is configured to be secured to the axle.

BRIEF DESCRIPTION OF THE DRAWINGS

Detailed description of preferred embodiments of the inventions will be made with reference to the accompanying drawings.

DETAILED DESCRIPTION OF THE EXEMPLARY EMBODIMENTS

The following is a detailed description of the best presently known modes of carrying out the inventions. This description is not to be taken in a limiting sense, but is made merely for the purpose of illustrating the general principles of the inventions.

Figure 1:
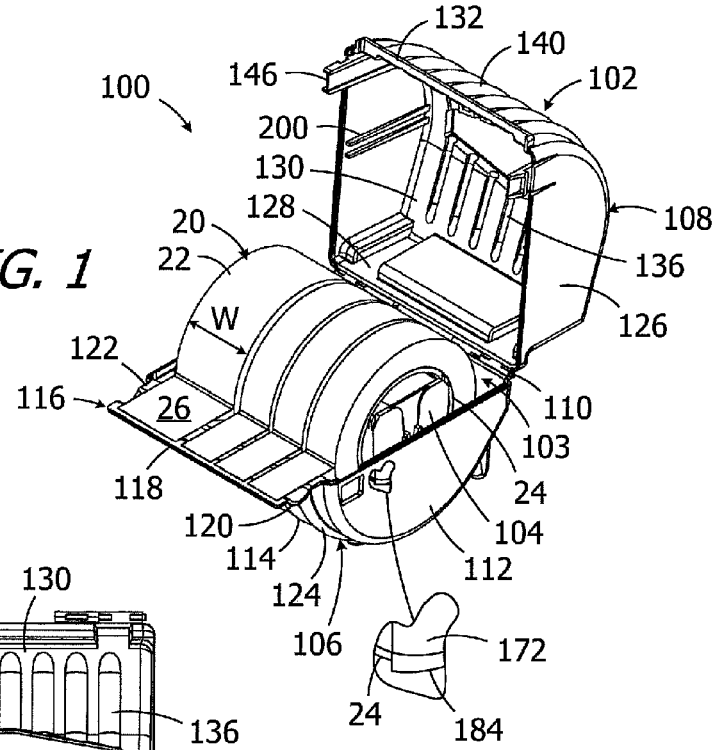
FIG. 1 is a perspective, cutaway view of a dispenser in accordance with one embodiment of a present invention in an open state with tape rolls in the dispenser.
Figure 2:
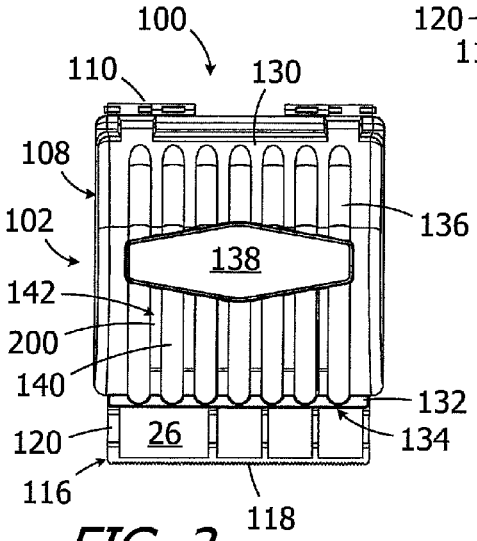
FIG. 2 is a top view of the dispenser illustrated in FIG. 1 in a closed state.
Figure 3:
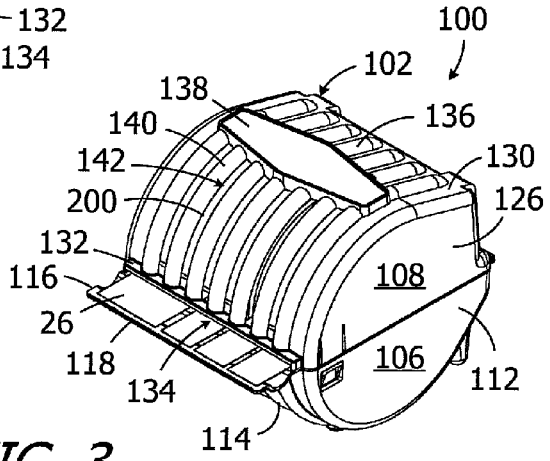
FIG. 3 is a perspective view of the dispenser illustrated in FIG. 1 in a closed state.

A dispenser in accordance with one embodiment of the present inventions is generally represented by reference numeral 100 in FIGS. 1-7. Referring first to FIGS. 1-3, the exemplary dispenser 100 includes a case 102 with an internal storage region 103 and an adjustable axle assembly 104 on which one or more tape rolls 20 may be supported. In the illustrated implementation, the axle assembly 104 does not rotate relative to the case 102, and the tape rolls 20 rotate around the axle assembly. The adjustability of the axle assembly 104 allows tapes rolls 20 of different widths W to be carried by the dispenser 100, as is discussed in greater detail below with reference to FIGS. 7-9. The tape rolls 20 include tape 22 that is wound around a core 24. The tape 22 may be any type of tape including, but not limited to, tape with a backing and a layer of adhesive (e.g., pressure sensitive adhesive or water activated adhesive) on one or both sides the backing. Exemplary tapes include, painter's tape, masking tape, adhesive tape, and packaging tape. The dispenser 100 may also be used to dispense other objects that are stored in rolled form, such as ribbon and barrier (or "police") tape, and do not include adhesive. The overall size of the dispenser case 102 and axle assembly 104 may be varied as required to accommodate rolls of various sizes.

The exemplary case 102 illustrated in FIGS. 1-3 includes a base 106 and a cover 108 that may be pivotally coupled to one another by a pair of hinges 110 or other suitable instrumentalities. The base 106 includes a pair of side walls 112 and a bottom wall 114. A support member 116, which includes a serrated edge 118 for cutting the tape 22, an indentation 120 to allow a finger to pick up the free end of the tape, and a bottom outlet wall 122, extends outwardly from the bottom wall 114. The serrated edge 118 may be integral with the support member 116 or may be a separate structure, such as a serrated metal structure, that is molded into or otherwise secured to the support member. The free end 26 of the tape 22, i.e. the end that has been pulled off the roll 20 but has yet to be dispensed, rests on the support member 116. The bottom wall 114 also includes a plurality of ridges 124 (see also FIGS. 6 and 12). The cover 108 includes a pair of side walls 126, a rear wall 128 and a top wall 130 that extends from the rear wall to a top outlet wall 132 near the support member 116. The bottom and top walls 114 and 130 are curved so as to define the generally cylindrically-shaped storage region 103 for the axle assembly 104 and tape rolls 20. The bottom and top outlet walls 122 and 132 are separated by a thin gap which forms the dispenser outlet 134 when the cover 108 is closed (FIGS. 2 and 3). The top wall 130 also include a plurality of ridges 136, a faceplate 138 for a trademark or other indicia, and a plurality of bars 140 that extend from the faceplate to outlet wall 132. Elongate apertures 142 are located between the bars 140. The apertures 142 allow the tape rolls 20 to be viewed from the outside of the dispenser 100 when the cover 108 is closed.

Figure 4:
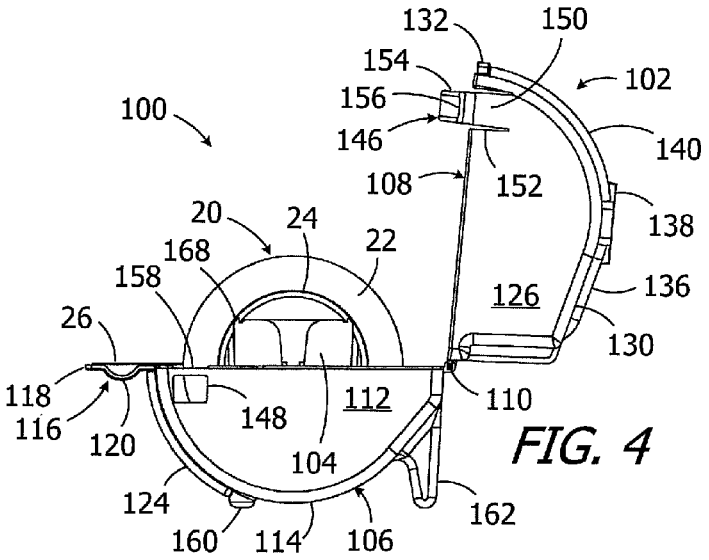
FIG. 4 is a side of the dispenser illustrated in FIG. 1 in an open state.
Figure 5:
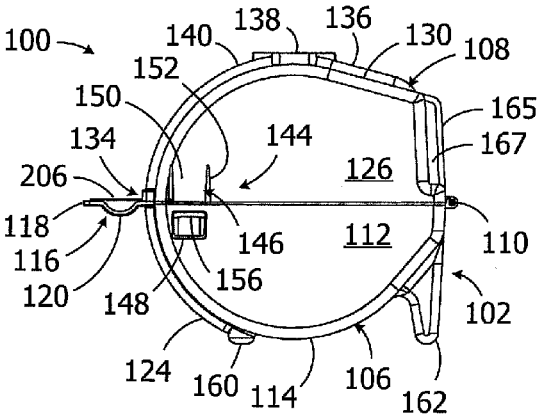
FIG. 5 is a side view of the dispenser illustrated in FIG. 1 in a closed state.

Turning to FIGS. 4 and 5, the exemplary dispenser 100 may also include a lock apparatus 144 that maintains the cover 108 is the closed position. In the exemplary embodiment, the lock apparatus 144 is configured to automatically lock when the cover 108 pivots from the open position to the closed position. The lock apparatus 144 includes a pair of latches 146 on the cover 108 and a pair of latch apertures 148 on the base 106. Each latch 146 includes an arm 150 that is located within, and is resiliently pivotable relative to, a slot 152 formed in the cover side wall 126. The free end of each arm 150 includes a cam surface 154 and a latch member 156. As the cover 108 is moving toward the base 106, the cam surfaces 154 will engage the top edges 158 of the side walls 112, thereby causing the latches 146 to pivot inwardly. The latches 146 will pivot outwardly, and the latch members 156 will enter the apertures 148, when the cover 108 reaches the closed position illustrated in FIG. 5, thereby locking the cover to the base 106. The lock apparatus 144 may be unlocked by pressing the latches 146 inwardly and pivoting the cover 108 about the hinges 110. It should be noted here that the positions of the latches 146 and apertures 148 may be reversed in other embodiments and that any suitable lock apparatus may be employed in other embodiments.

Figure 6:
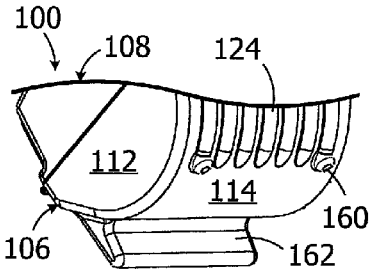
FIG. 6 is a bottom perspective view of a portion of the dispenser illustrated in FIG. 1.
Figure 6A:
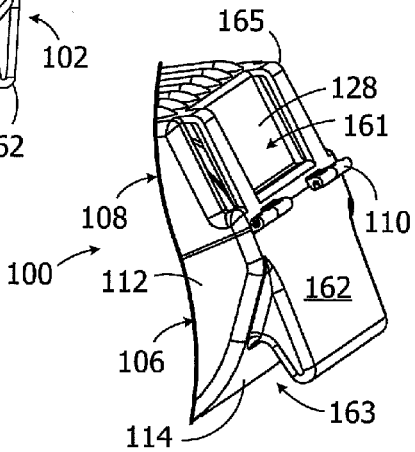
FIG. 6A is a rear perspective view of a portion of the dispenser illustrated in FIG. 1.

The exemplary dispenser 100 may also be configured to maintain the orientation illustrated in FIGS. 4 and 5 when the dispenser 100 is placed on a horizontal surface. To that end, and referring to FIGS. 6 and 6A, the case 102 includes a pair of support posts 160 and a support beam 162 that maintain the illustrated orientation. The dispenser 100 is also configured to be held by or secured to a user. With respect to holding, the rear wall 128 of the cover 108 includes a recess 161, and a recess 163 is located between the base bottom wall 114 and the support beam 162. The user is readily able to grip the dispenser 100 with one hand by, for example, placing the thumb in recess 161 and the remaining four fingers into recess 163 behind the support beam 162. The other hand can be used to pull tape 22 from the dispenser 100 and sever the pulled portion with the serrated edge 118. Additionally, the rear wall 128 includes a pair of belt loops 165 that define openings 167 through which a belt may be threaded.

Figure 7:
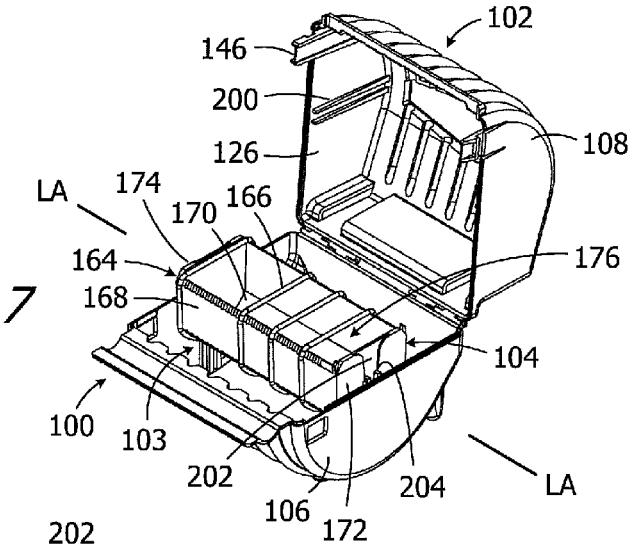
FIG. 7 is a perspective view of the dispenser illustrated in FIG. 1 with the tape rolls removed from the dispenser so that the axle assembly is visible.
Figure 8:
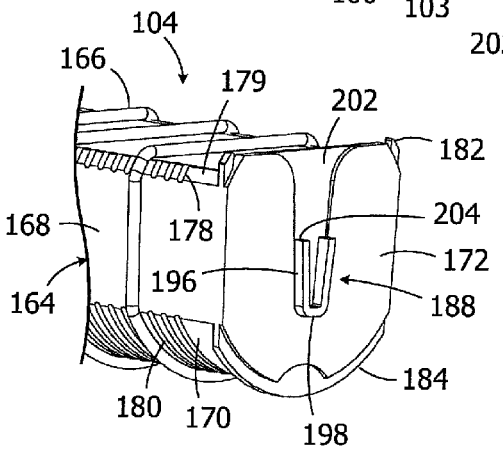
FIG. 8 is a perspective view of a portion of the axle assembly.
Figure 9:
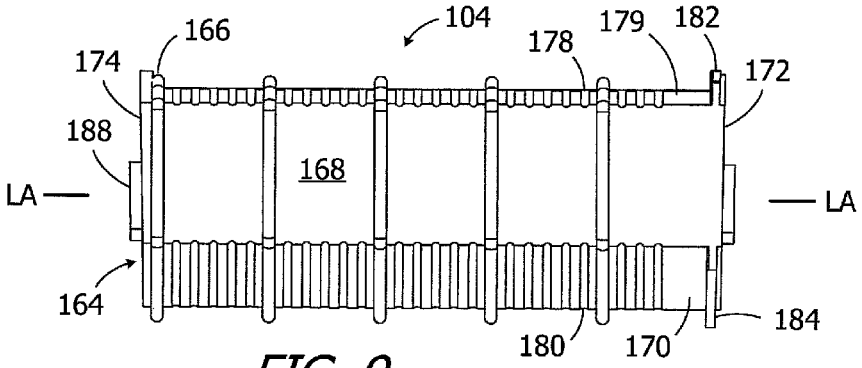
FIG. 9 is a side view of the axle assembly.

As illustrated in FIGS. 7-9, the exemplary adjustable axle assembly 104 includes an axle 164 that defines a longitudinal axis LA and a plurality of movable stops 166 that prevent rolls, such as tape rolls 20, from moving along the longitudinal axis. The movable stops 166 also create a small gap between adjacent rolls (FIG. 1) to prevent the rolls from sticking to one another. The movable stops 166 may be fixedly positioned at essentially any location along the length of the axle 164, and may be moved or removed, as is discussed in greater detail below. Although the axle 164 is mounted in the base 106 in the illustrated embodiment, it may be mounted in the cover in other embodiments. The axle 164 is also removably mounted to permit the associated rolls to be replaced and to permit the stops 166 to be moved or removed.

The exemplary axle 164 illustrated in FIGS. 7-9 includes a pair of planar side walls 168, a curved bottom wall 170, and a pair of end walls 172 and 174. The walls 168-174 together define an axle body. So configured, the axle 164 includes an open internal region 176. The axle 164 also has a U-shaped cross-section in a plane perpendicular to the longitudinal axis LA. A plurality of relatively short indentations 178 are located at the beveled ends 179 (i.e., the top end in the illustrated orientation) of each of the side walls 168, and a plurality of relatively long indentations 180 extend along the bottom wall 170 from the one side wall to the other side wall. Each indentation 180 on the bottom wall is aligned, in the direction of the longitudinal axis LA, with an indentation 178 on each of the side walls 168 to form a three-indentation set. The stops 166 may be moved from one three-indentation set to another to accommodate rolls of different widths as is described below.

There are a variety of advantages associated with the U-shaped cross-sectional configuration of the axle 164. By way of example, but not limitation, the present axle 164 is easier to mold than would be a similar axle with a hollow, closed (e.g. circular) cross-sectional shape. The open internal region 176 allows the user to easily grasp the movable stops 166 during removal or placement thereof, as compared to a similar structure with a closed (e.g. circular) cross-sectional shape. Along these lines, the lack of indentations along the side walls 168 also makes movement of the stops 166 easier. It should also be noted that the beveled ends 179 of the side walls 168 and the outer surface of the bottom wall 170 lie along a common circumference that is defined by the curvature of the bottom wall and extends around the longitudinal axis LA. As such, there are three possible areas of contact between the axle 164 and the tape core 24, i.e., the beveled top end 179 of each of the two side walls 168 and the outer surface of the bottom wall 170. This reduces the amount of friction between the tape core 24 and the axle 164, as compared to an axle that engages the tape roll all the way around the inner surface of the core as the tape roll rotates around the axle 164 in the manner described below. Additionally, the diameter of the common circumference may be about $2^{15}/_{16}$ inches, which is slightly less than the 3 inch inner diameter of a typical tape core 24, thereby further reducing the amount of contact and friction between the axle 164 and the tape core.

Figure 10:
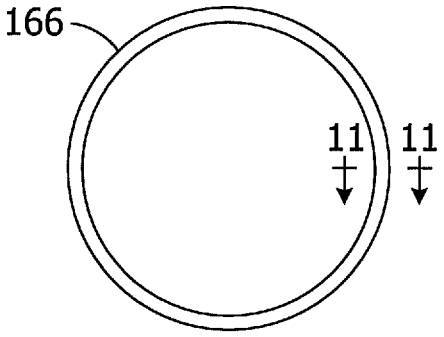
FIG. 10 is a plan view of an exemplary movable stop.
Figure 11:
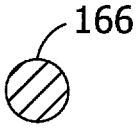
FIG. 11 is a section view taken along line 11-11 in FIG. 10.

The exemplary movable stops 166 may be resilient members that are toroidal and circular in cross-section as illustrated in FIGS. 10 and 11 or any other suitable shape. The axle 164, including the side and bottom walls 168 and 170 and indentations 178 and 180, and the movable stops 166 are respectively sized such that each movable stop can be stretched, pulled over the axle and positioned within a respective three-indentation set of the indentations 178 and 180 in the manner illustrated in FIGS. 7-9. The movable stops 166 will be stretched out of their relaxed circular shape (FIG. 10), i.e., in tension, into the D-shape illustrated in FIGS. 7-9. The respective positions of the movable stops 166 will depend on the widths of the tape rolls 20 and the user's preferred tape roll positioning. Suitable materials for the exemplary movable stops include 166, but are not limited to, rubber, nylon, and other elastomers. Other exemplary movable stops include, but are not limited to, metal clips and elastomeric rings coated with woven material (e.g., a hair band).

Referring to FIGS. 8 and 9, the exemplary axle 164 also includes a pair of relatively small fixed stops 182 adjacent to the end wall 172 and at the beveled end 179 of each of the side walls 168. A relatively long fixed stop 184 extends around the bottom wall 170 adjacent to the end wall 172. The fixed stops 182 and 184 extend outwardly, in a plane perpendicular to the longitudinal axis LA, from the side and bottom walls 168 and 170 and are sized such they will extend beyond the inner diameter of the tape roll core 24 (FIGS. 1 and 4) and prevent the tape roll 20 from moving beyond the end wall 172. There are no such fixed stops adjacent to the end wall 174.

With respect to the manner in which the tape rolls 20, or other rolls, are mounted on the axle assembly 104 when the assembly is out of the case 102, the movable stops 166 may be removed from the axle 164. A tape roll 20 may then be placed over the end wall 174 and moved in the axial direction towards the end wall 172 until the tape roll abuts the fixed stops 182 and 184. A movable stop 166 may then be positioned against the tape roll core 24 and within the three-indentation set of indentations 178 and 180 that is adjacent to the side to the tape roll 20 that faces the end wall 174. This process may be repeated until, for example, the axle 164 is full (FIG. 1) and a movable stop 166 is located in the indentations 178 and 180 closest to the end wall 174 (FIG. 9).

As noted above, the axle assembly 104 may be removed from the case 102 so that, for example, tape rolls 20 may be removed and replaced. In the illustrated implementation, the axle assembly 104, base 106 and cover 108 are also respectively configured such that, the position of the axle assembly will be fixed when the axle assembly is placed into the base and the cover is closed.

Figure 12:
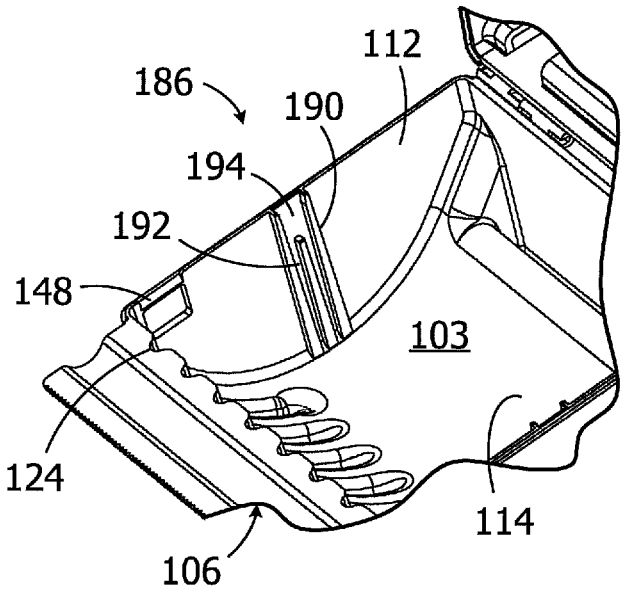
FIG. 12 is a perspective view of a portion of the dispenser illustrated in FIG. 1 with the axle assembly and tape rolls removed.

Referring to FIGS. 8 and 12, each of the base side walls 112 includes a receiver 186 that is configured to receive one of the tabs 188 on the end walls 172 and 174 of the axle 164. In the exemplary implementation, the receiver 186 includes first and second protrusions 190 and a third protrusion 192. The third protrusion 192 has an end that is offset from the ends of the protrusions 190 such that a slot 194 is defined by the protrusions. Each slot 194 tapers downwardly from the open end thereof to the end of the third protrusion 192, and the taper of the slots corresponds to the taper of the v-shaped outer surfaces 196 of the tabs 188. When the tabs 188 are inserted into the receivers 186, the side outer surfaces 196 of each tab will engage the inner surfaces of the first and second protrusions 190, while the closed end 198 of each tab will engage the end of the third protrusions 192. At this point, the axle 164 is fully inserted into the base 106 and is in its dispensing location. The respective configurations of the receivers 186 and tabs 188 prevent rotation of the axle assembly 104 relative to the base 106 about the longitudinal axis LA. As such, during dispensing, the rolls 20 rotate around the axle assembly 104 (i.e., rotate about the longitudinal axis LA). The axle assembly 104 is, however, free to move vertically (in the illustrated orientation) relative to the base when the cover 108 is opened, and the axle assembly can be removed by simply pulling it out of base 106.

The axle 164 and cover 108 may be configured to lock the axle assembly 104 into the case 102. In the illustrated implementation, and referring to FIGS. 7 and 8, each of the side walls 126 of the cover 108 includes a pair of protrusions 200. The protrusions 200 on each of the side walls 126 pass through the channels 202 on the axle end walls 172 and 174 as the cover moves from the open position to the closed position (FIG. 5). The channels 202 are tapered, with larger open ends, to insure that the protrusions 200 enter the channels without interference. The ends of the protrusions 200 will engage the open ends 204 of the tabs 188 when the cover 108 reaches the closed position, thereby pressing the tabs 188 firmly into the receivers 186 and the tab closed ends 198 firmly against the protrusions 192 to prevent movement of the axle assembly 104. The lock apparatus 144 will hold the cover 108 in the closed position until it is unlocked by the user.

It should be noted here that the present inventions are not limited to above described receiver and tab arrangement, and that other ways to maintain the removable axle assembly in the case may be employed. The axle assembly may also be rotatable relative to the case in some embodiments.

The materials and size of the dispenser 100 will depend on the intended usage. Suitable materials include, but are not limited to, thermoplastic polymers such as polypropylene. A dispenser 100 that is configured for tape rolls that are about 5 inches in outer diameter, will be about 6 to 6¾ inches high (bottom to top), about 6 to 6¾ inches wide (side to side) and about 6 to 6¾ inches long (front to back).

Although the present inventions have been described in terms of the preferred embodiments above, numerous modifications and/or additions to the above-described preferred embodiments would be readily apparent to one skilled in the art. By way of example, but not limitation, the present inventions include assemblies that comprise a dispenser as described above in combination with a plurality of roll (e.g. tape rolls) located in the internal storage region of the dispenser, and the hinges may be omitted and separable bases and cases may be provided that can be attached and detached as necessary. It is intended that the scope of the present inventions extends to all such modifications and/or additions.

I claim:

1. A dispenser for use with a rolled object, the dispenser comprising:

a case including a base and a cover that together define an internal storage region; and an adjustable axle assembly, mounted within the internal storage region of case, including an axle defining a longitudinal axis and including a plurality of longitudinally spaced indentations, and at least one resilient movable stop that is configured to be secured to the axle, the axle and the resilient movable stop being sized such that the resilient movable stop will be in tension when the resilient movable stop is positioned around the axle and in an indentation.

2. A dispenser as claimed in claim 1, wherein the base is secured to the cover by a hinge.

3. A dispenser as claimed in claim 1, wherein the cover includes a plurality of longitudinally extending slots that allow the internal storage region to be observed from outside the case.

4. A dispenser as claimed in claim 1, wherein the at least one resilient movable stop comprises a plurality of resilient movable stops.

5. A dispenser as claimed in claim 1, wherein the plurality of longitudinally spaced indentations comprises a plurality of longitudinally spaced indentation sets, each indentation set including a plurality of longitudinally aligned indentations; and the axle and the resilient movable stop are sized such that the resilient movable stop will be in tension when the resilient movable stop is positioned around the axle and in an indentation set.

6. A dispenser as claimed in claim 5, wherein the axle includes first and second planar side walls and a curved bottom wall that extends from the first side wall to the second side wall; and the indentations in each indentation set are located at an end of at least one of the first and second side walls and on the curved bottom wall.

7. A dispenser as claimed in claim 6, wherein the axle defines a U-shaped cross-section in a plane perpendicular to the longitudinal axis.

8. A dispenser as claimed in claim 1, wherein the axle assembly and case are respectively configured such that the axle assembly can be connected to and disconnected from the case.

9. A dispenser as claimed in claim 8, wherein the axle assembly and case are respectively configured such that the axle assembly is not rotatable relative to the case when connected to the case.

10. A dispenser as claimed in claim 9, wherein the axle includes first and second end walls and first and second axle tabs extending from the first and second end walls, the axle tabs defining an axle tab shape;

the case base includes first and second receivers that are configured to receive the axle tabs and define a receiver shape; and the axle tab shape and the receiver shape are such that the axle tabs are prevented from rotating relative to the receivers when the axle tabs are located within the receivers.

11. A dispenser as claimed in claim 10, wherein the case cover is movable between an open position and a closed position and includes first and second protrusions that engage the first and second axle tabs when the cover is in the closed position to press the first and second axle tabs against the first and second receivers.

12. A dispenser as claimed in claim 11, wherein the first and second axle end walls include respective channels for the first and second protrusions on the case cover.

13. A dispenser as claimed in claim 1, wherein the axle defines first and second longitudinal ends;

the first longitudinal end includes at least one fixed stop that extends outwardly in a plane perpendicular to the longitudinal axis; and the second longitudinal end does not include a fixed stop.

14. A dispenser as claimed in claim 1, wherein the case base includes a bottom wall and a support beam extending outwardly from the bottom wall.

15. A dispenser as claimed in claim 14, wherein a finger recess is defined between the support beam and the bottom wall;

the case cover defines a thumb recess; and the support beam is located between the finger recess and the thumb recess.

16. A dispenser as claimed in claim 15, wherein the case base includes first and second support posts outwardly from the bottom wall.

17. A dispenser as claimed in claim 15, wherein the case cover includes first and second belt loops on opposite sides of the thumb recess.

* * * * *